US009734805B1

(12) United States Patent
Caccia

(10) Patent No.: US 9,734,805 B1
(45) Date of Patent: Aug. 15, 2017

(54) GUITAR AID

(71) Applicant: Kay Caccia, Bagley, MN (US)

(72) Inventor: Kay Caccia, Bagley, MN (US)

( * ) Notice: Subject to any disclaimer, the term of this patent is extended or adjusted under 35 U.S.C. 154(b) by 0 days.

(21) Appl. No.: 15/014,735

(22) Filed: Feb. 3, 2016

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | |
|---|---|---|---|
| 756,348 | A | 4/1904 | Forney |
| 1,787,136 | A | 12/1930 | Beauchamp |
| 2,063,011 | A | 12/1936 | Bell |
| 2,221,234 | A | 11/1940 | Frasier |
| 2,776,592 | A | 1/1957 | Di Preta |
| 3,442,169 | A | 5/1969 | Bowers |
| 3,648,558 | A | 3/1972 | Chenette |
| 3,699,838 | A | 10/1972 | Montgomery |
| 3,789,720 | A | 2/1974 | McIntyre |
| 4,020,732 | A | 5/1977 | Kelly |
| 4,270,433 | A | 6/1981 | Adamec |
| 4,625,616 | A | 12/1986 | McVicker |
| D291,809 | S | 9/1987 | Jasper |
| 4,867,032 | A | 9/1989 | Lukehart |
| 4,879,940 | A | 11/1989 | Pereira |
| 5,323,677 | A | 6/1994 | Knutson |
| 5,509,341 | A | 4/1996 | Dunlop |
| 5,864,075 | A | 1/1999 | Mapson |
| 5,973,243 | A | 10/1999 | Christenson |
| 5,981,857 | A | 11/1999 | Mapson |
| 6,335,477 | B1 | 1/2002 | Miller |
| 6,797,871 | B2 | 9/2004 | Atkin |
| 6,949,700 | B1 | 9/2005 | Kelly |
| 6,977,330 | B2 | 12/2005 | Santa Cruz et al. |
| 7,157,635 | B2 | 1/2007 | Sogabe |
| 7,179,976 | B2 | 2/2007 | West |
| 7,312,386 | B2 | 12/2007 | Sielaff et al. |
| 7,371,950 | B2 | 5/2008 | Benyahia et al. |

(Continued)

OTHER PUBLICATIONS

Application and File history for U.S. Appl. No. 14/553,220, filed Nov. 25, 2014, now U.S. Pat. No. 9,240,167. Inventor: Caccia.

*Primary Examiner* — Kimberly Lockett
(74) *Attorney, Agent, or Firm* — Patterson Thuente Pedersen, P.A.

(57) ABSTRACT

A guitar aid enables a user to selectively position and control tension and angle of a guitar pick for a richer sound with decreased strain on the user's hand and fingers. The guitar aid can includes a ring member defining an opening sized and shaped to fit around a finger of a user and a pick retainer unitarily formed with the ring member and configured to secure a guitar pick therein. The pick retainer can include first, second, and third retentions arms extending outwardly from the ring member and defining pick receiving channels configured to receive and secure a guitar pick therein. The guitar aid can also include at least one retention nub extending upwardly from and unitarily formed with the ring member, the retention nub being configured to contact a body of the guitar pick when the guitar pick is positioned within the pick receiving channels.

19 Claims, 7 Drawing Sheets

(56) References Cited

U.S. PATENT DOCUMENTS

| | | | | |
|---|---|---|---|---|
| D603,891 | S | 11/2009 | Whetstine | |
| 7,786,362 | B1 | 8/2010 | Whetstine | |
| D632,725 | S | 2/2011 | Goad | |
| 7,977,557 | B2 | 7/2011 | Broderick | |
| 8,263,845 | B2 | 9/2012 | McDonald | |
| 8,389,838 | B2 | 3/2013 | Aletto et al. | |
| 9,240,167 | B2 | 1/2016 | Caccia | |
| 2002/0178891 | A1 | 12/2002 | Atkin | |
| 2005/0204893 | A1 | 9/2005 | Luschniu | |
| 2005/0211053 | A1 | 9/2005 | Ball | |
| 2008/0178725 | A1 | 7/2008 | Goad | |
| 2009/0056521 | A1 | 3/2009 | Goad | |
| 2009/0084244 | A1 | 4/2009 | Goad | |
| 2009/0139384 | A1 | 6/2009 | Bramucci | |
| 2010/0180747 | A1* | 7/2010 | Swartz | G10D 3/163 84/322 |
| 2010/0263515 | A1 | 10/2010 | Hollin, Jr. | |
| 2012/0260788 | A1 | 10/2012 | Leneman | |

* cited by examiner

GUITAR AID

TECHNICAL FIELD

The present invention relates to the use of a guitar pick for playing stringed instruments and more particularly, to a guitar aid that provides a user with the ability to apply a controlled tension while maintaining a fixed position of the guitar pick while playing a guitar or other stringed instrument.

BACKGROUND

Guitar picks are typically small, flat apparatuses that are triangular shaped with rounded edges. The pick can be used to pluck or strum stringed musical instruments such as guitars. Use of a guitar pick can help generate a higher quality sound and improve the ability of a musician to strike large chords. A pick is generally made of a rigid material such as metal or plastic and is lightweight and may vary in thickness based on the desired sound quality.

Conventionally, picks have been designed for placement between a user's thumb and one or more fingers to assist while playing instruments such as the guitar. Drawbacks of this technique, however, include difficulty of maintaining a fixed position and proper control of the pick and proper tension on the pick while playing an instrument. For example, if the pick is held too loosely, it could cause the pick to shift in the musician's fingers, affecting the ability of the musician to retain a proper grip on the pick. Conversely, holding the pick too tightly can interfere with the play of the instrument by distorting the sound. Sound quality can also be negatively impacted if the pick is not held at a proper 90-degree angle to the strings.

Mounting apparatuses such as rings or band-like structures have been designed to secure a guitar pick onto a user's finger or thumb. Such designs, however, are directed towards preventing accidental dropping of a guitar pick and/or providing a user with the ability to interchangeably alternate between the use of a user's finger and a guitar pick to strum or pluck instrument strings.

Designs for guitar aids that are used to assist with proper pick angle and placement for enhanced sound quality are disclosed in U.S. Pat. No. 9,240,167, invented by the inventor of the present application, the disclosure of which is incorporated herein by reference. This patent includes both a guitar aid designed to removably receive a pick and a unitarily formed pick and ring combination.

SUMMARY

A guitar aid enables a user to selectively position and control tension and angle of a guitar pick for a richer sound with decreased strain on the user's hand and fingers. The guitar aid can include a ring member defining an opening size and shape to fit around a finger of a user and a pick retainer unitarily formed with the ring member and configured to secure a guitar pick therein. The pick retainer can include first, second, and third retentions arms extending outwardly from the ring member and defining pick receiving channels configured to receive and secure a guitar pick therein. The guitar aid can also include at least one retention nub extending upwardly from and unitarily formed with the ring member, the retention nub being configured to contact a body of the guitar pick when the guitar pick is positioned within the pick receiving channels.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
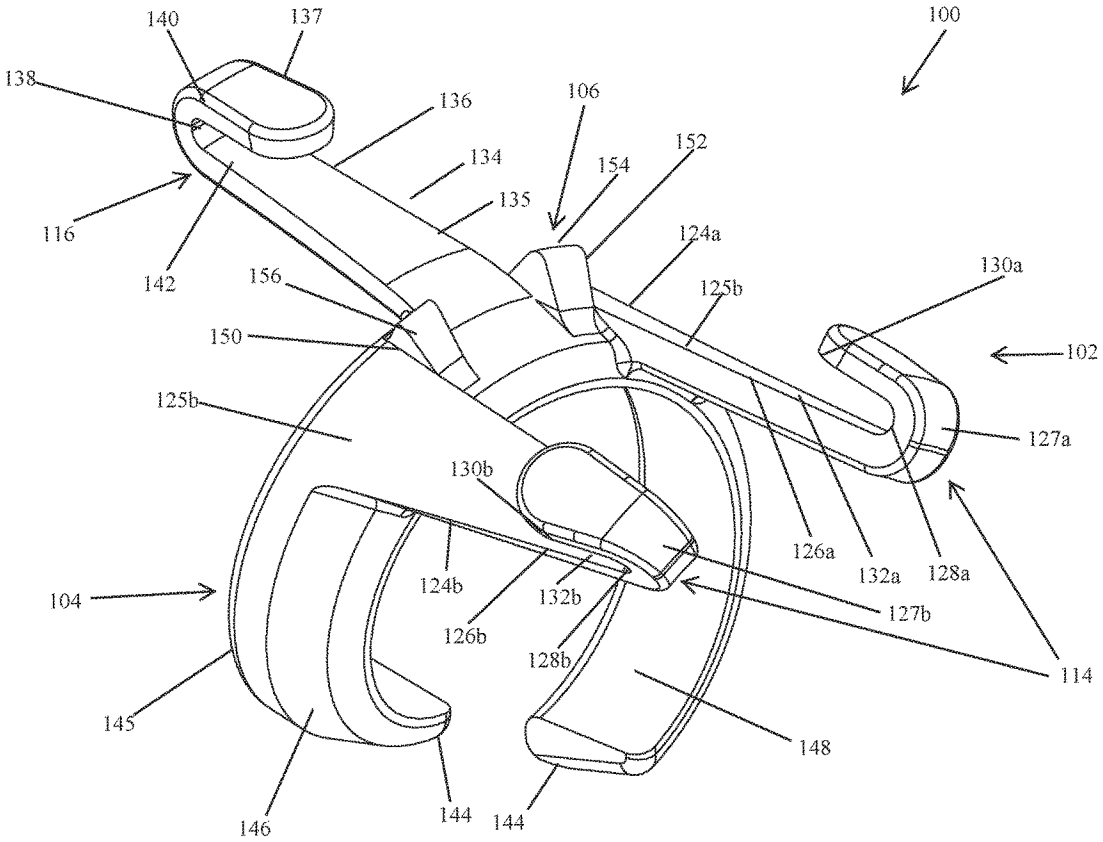
FIG. 1 is a perspective view of a guitar aid according to an embodiment of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Figure 2:
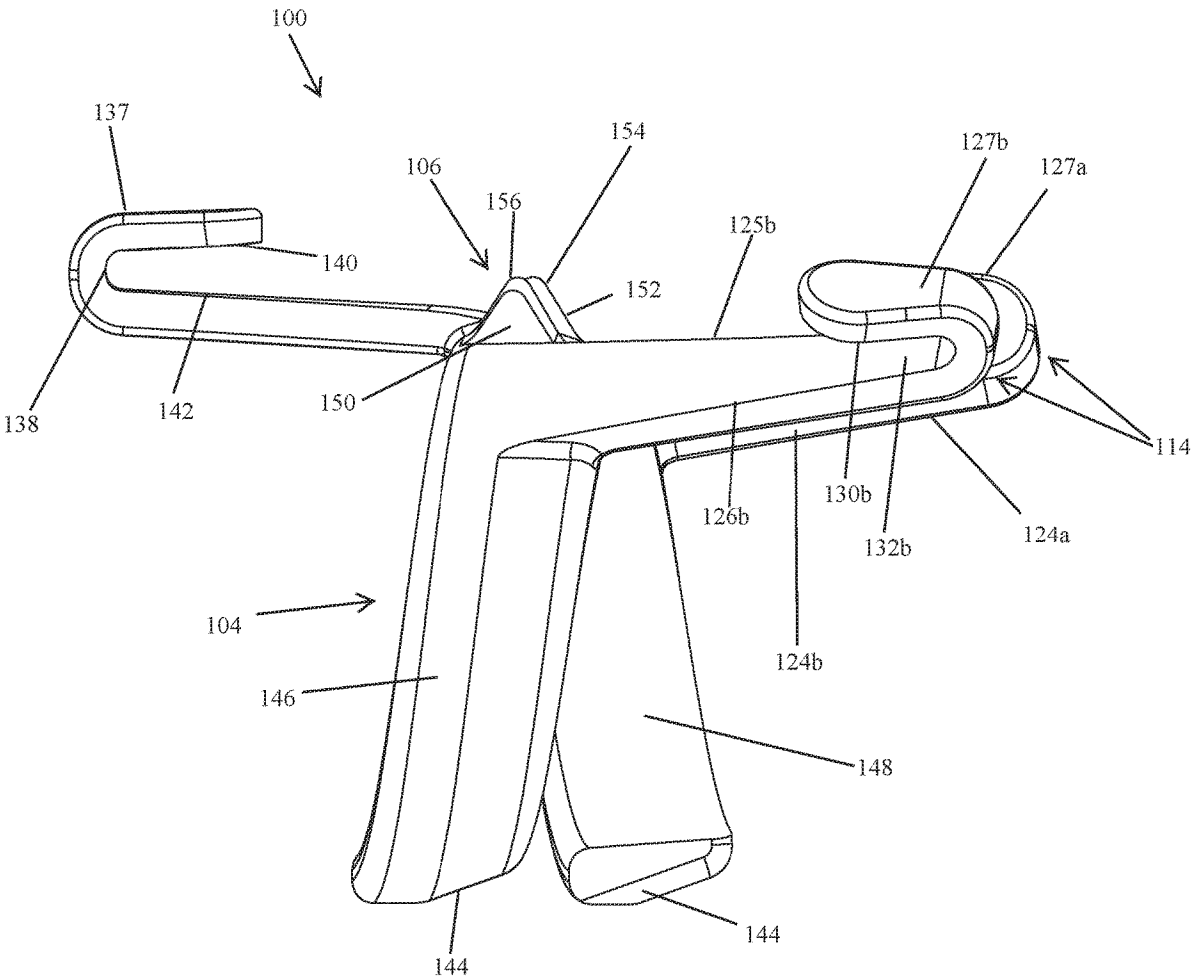
FIG. 2 is a side view of a guitar aid according to an embodiment of the present invention.
Figure 3:
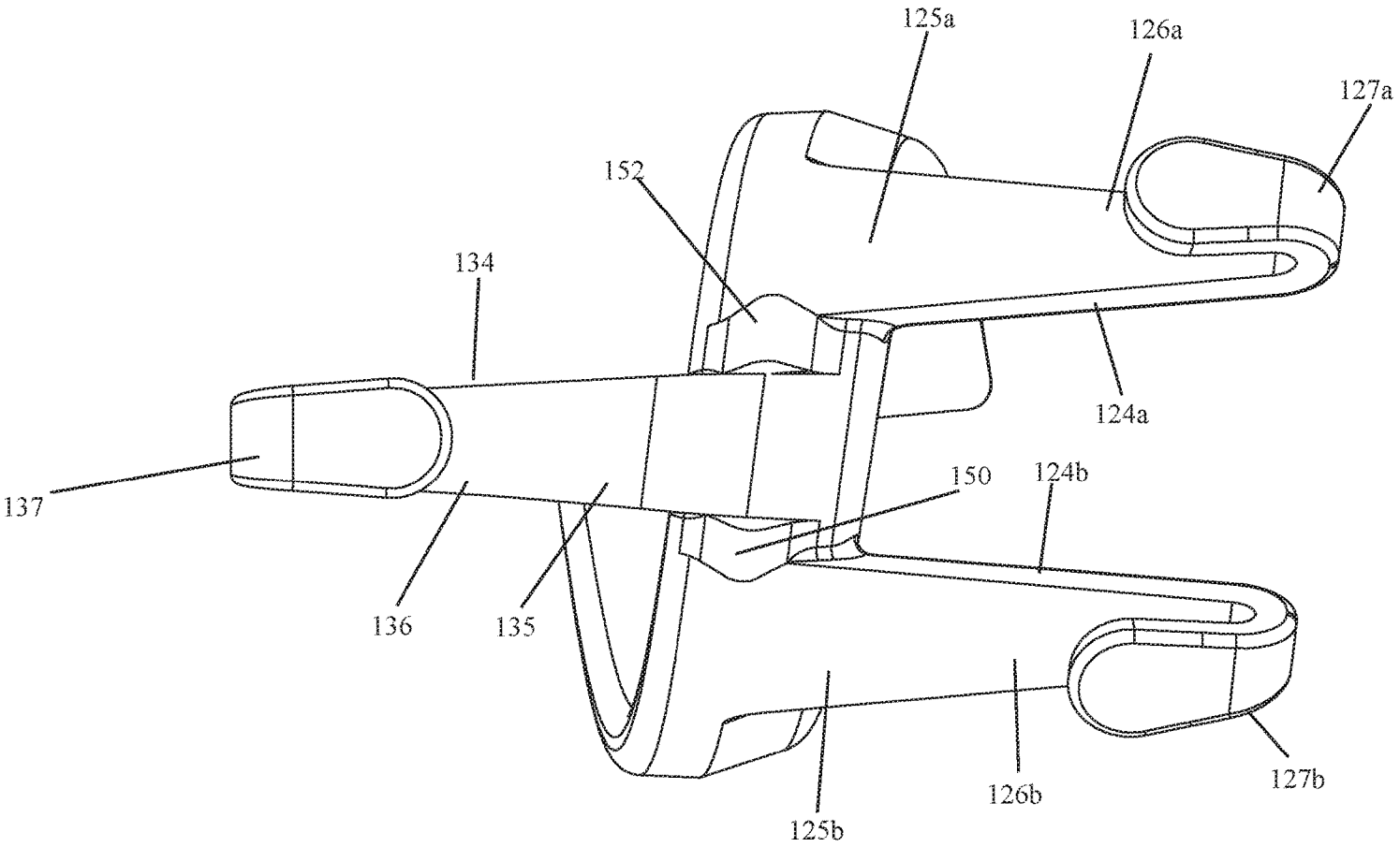
FIG. 3 is a top view of a guitar aid according to an embodiment of the present invention.
Figure 7:
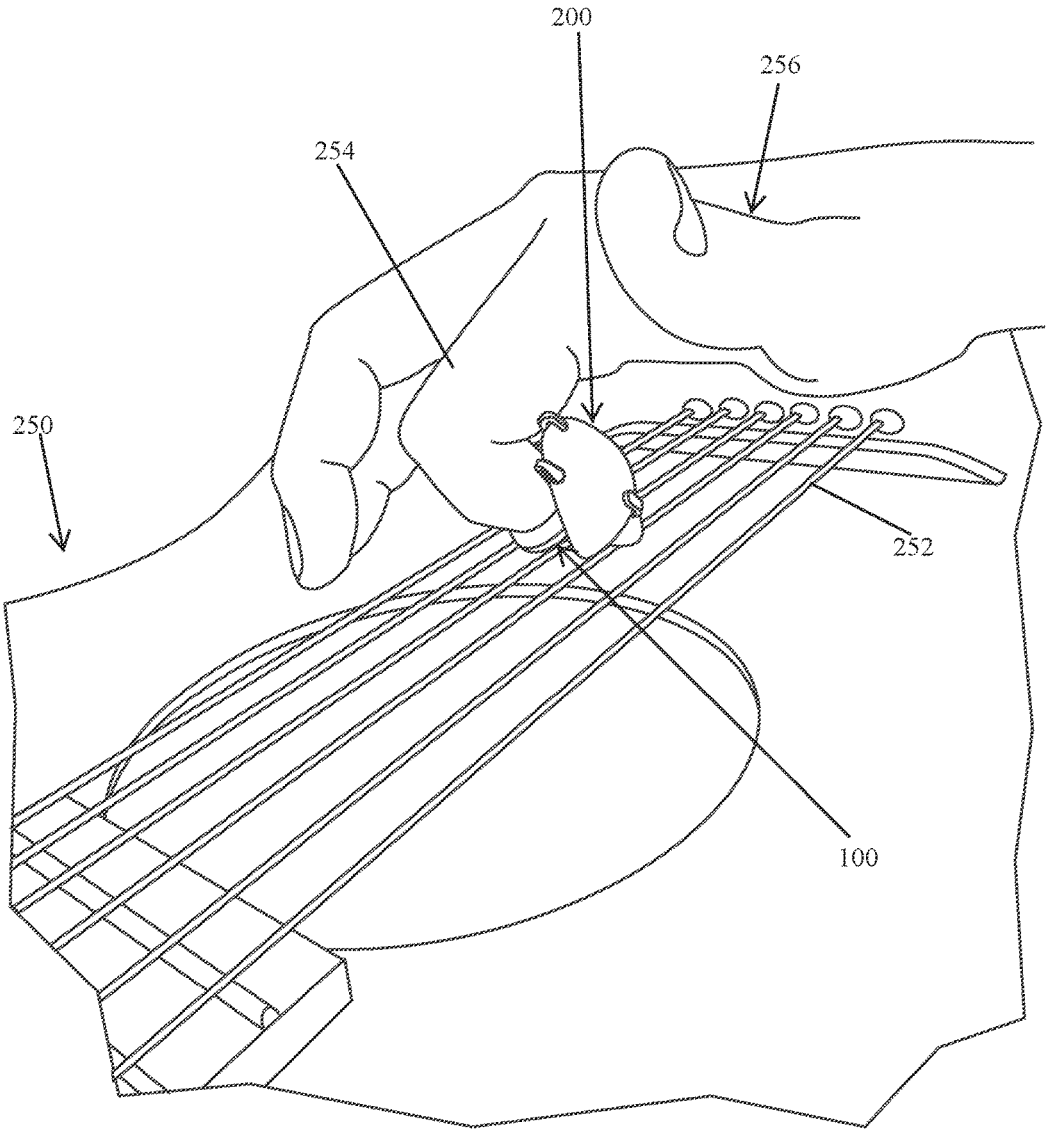
FIG. 7 is a drawing illustration of the guitar aid of FIGS. 1-6 positioned on the index finger of a user according to an embodiment of the present invention.

Referring to FIGS. 1-3, a guitar aid 100 according to an embodiment of the present invention is depicted. Guitar aid 100 comprises a pick retainer 102, center support structure 106, and a ring member 104 that can be adjusted in size to fit a user's finger. Ring member 104 can comprise an arcuate body portion 145 having a pair of ends 144 defining a space therebetween. Body portion 145 includes an outer surface 146 to which pick retainer 102 couples and an inner surface 148 defining an opening for a user's finger (typically the user's index finger as shown in FIG. 7). Ring member 104 can be comprised of a pliable material such that ring member 104 can easily adjust to fit different finger sizes. The material can be any material having such flexibility, including polymer and metal materials. In some embodiments, ring member 104 can be injection molded. In one embodiment, as can be seen in, e.g., FIG. 2, arcuate body portion 145 can define a generally helical shape such that ends 144 are generally laterally offset from each other and do not align with or abut each other. This offset further enhances the flexibility of the ring member 104 to conform to different user's fingers and to be adjusted along a given user's finger (e.g., to be positioned to use the pick or moved along the user's finger to allow the user to pick the strings of the guitar with the user's fingers). In alternative embodiments, ring member 104 can comprise a complete circle of material.

Pick retainer 102, which is configured to retain a guitar pick 200 (refer, e.g., to FIG. 4) in position without the need for a user to hold the guitar pick in place in the retainer, can be unitarily formed with ring member 104 as a single unitary construct. Alternatively, pick retainer can be attached to ring member through welding or other means. In embodiments, pick retainer 102 can comprise a first retention portion 114 and a second retention portion 116. It should be noted, however, that pick retainer 102 can comprise fewer or more retention portions in other embodiments.

First retention portion 114 can be arranged such that it extends laterally outwardly from ring member 104 in a direction opposite that of second retention portion 116. First retention portion 114 can comprise a first retention arm 124*a* and a second retention arm 124*b*. In some embodiments, arms 124*a*, 124*b* can each have a tapered design such that a wider portion 125*a*, 125*b* tapers inwardly toward a thinner portion 126*a*, 126*b* to provide increased strength at the point of attachment with ring member 104. Each arm 124*a*, 124*b* can include a clamp member 127*a*, 127*b* that defines a pick receiving channel 128*a*, 128*b*. Pick receiving channel or slot 128*a*, 128*b* can comprise an upper inner surface 130*a*, 130*b* and lower inner surface 132*a*, 132*b* that interface, respectively, with a top surface and a bottom surface of a guitar pick 200 upon insertion into channels 128*a* and 128*b*. Such a configuration allows for the effortless and sustained placement of guitar pick 200.

In various embodiments, the distance between upper inner surfaces 130*a*, 130*b*, 140 and lower inner surfaces 132*a*, 132*b*, 142 (i.e., channel widths) can vary for a given guitar aid to accommodate guitar picks of different thicknesses. However, pick retainer 102 is configured to accommodate picks of different thicknesses with single channel width. As can be seen in, e.g., FIG. 2, each clamp member 127*a*, 127*b*, 137 and corresponding channel can be rotationally offset from one another, with each channel 128*a*, 128*b*, 138 aligned parallel with the circumferential portion of the ring member 102 from which it extends. The angling of the clamp members enhances the ability to maintain a firm hold of picks of different thicknesses during use with the same channel width, while still making the picks easy to remove and insert from the pick retainer. As can also be seen in FIG. 2, with respect to upper inner surface 140, one or more of the inner surfaces 130*a*, 130*b*, 140 and corresponding hook portion of the clamp member can taper upwardly towards the ring member 102, which aids in insertion and guidance of the pick into the channels.

The design and structure of the arm 134 of second retention portion 116 is substantially similar to that of the arms 124*a*, 124*b* of first retention portion 114 in that it tapers from a wider portion 135 to a narrower portion 136 having a clamp member 137. Clamp member 137 similarly defines a pick receiving channel 138 with an upper inner surface 140 and a lower inner surface 142. Use of three arms in the depicted embodiment provides a more secure hold of the pick to aid in stability of the pick within the pick retainer 102 and guidance of the pick into a proper position within the guitar aid. The pick can more easily snap into place in the retainer with a guiding slot at three positions and is held along a first side of the pick and a second side of the pick (in two places) for the more secure and firm retention. As shown in, e.g., FIG. 3, the arm 134 of second retention portion can be generally centrally located between the arms 124*a*, 124*b* of the first retention portion, equidistant from each.

As can be seen in the Figures, the arms 124*a*, 124*b*, 134 of retention portions can be formed of a solid material that, as discussed above can be unitary formed with the ring member 104. This solid construction provides needed strength to the pliable arm portions because as the user plays a stringed instrument such as a guitar with the device, continuous strain and movement is placed on arms, and under these conditions the previously disclosed wire retention members were prone to breakage. In various embodiments, the arms are comprised of a plastic or other polymer material. In one embodiment, the material is Delrin® plast. Such a solid material is more durable and flexible such that it does not break with use while still being light weight and comfortable to wear. In addition, during use it was found that the pick may slip or shift position within the wire retention members and the solid plastic of the described embodiment holds the pick more firmly in place while still providing the proper tension for proper sound quality.

In some embodiments, center support structure 106 can include one or more upwardly protruding members or retention nubs 150, 152. In one embodiment, two nubs 150, 152 are centrally located on opposing sides of second retention portion 116 and between the arms 124*a*, 124 of first retention portion 114. The protruding members 150, 152 can comprise a generally inverted V-shape, but may vary in other embodiments. For example, in other embodiments, members protruding members 150, 152 can comprise a generally circular, spherical, or hemispherical shape, rectangular shape, or other suitable configurations. As illustrated in FIGS. 2 and 3, protruding members 150, 152 can be configured such that a top portion 154, 156 extends upwardly from ring member 104 to a predetermined height above ring member 104 at a position that is located between upper inner surfaces 130*a*, 130*b*, 140 and lower inner surfaces 132*a*, 132*b*, 142 of pick receiving channels 128*a*, 128*b*, 138 (refer, e.g., to FIG. 2). Nubs 150, 152 therefore push a middle of the pick 200 up slightly. Such a configuration is advantageous in that support structure 106 causes a tighter fit for the pick 10 to provide additional support to pick 200 and minimizes movement of pick 200 once it is inserted into first and second retention portions 114, 116. In addition, nubs 150, 152 aid the device in accommodating different thicknesses of picks, providing further flexibility of the user to choose a preferred pick thickness or vary pick thicknesses used with the same guitar aid.

Figure 4:
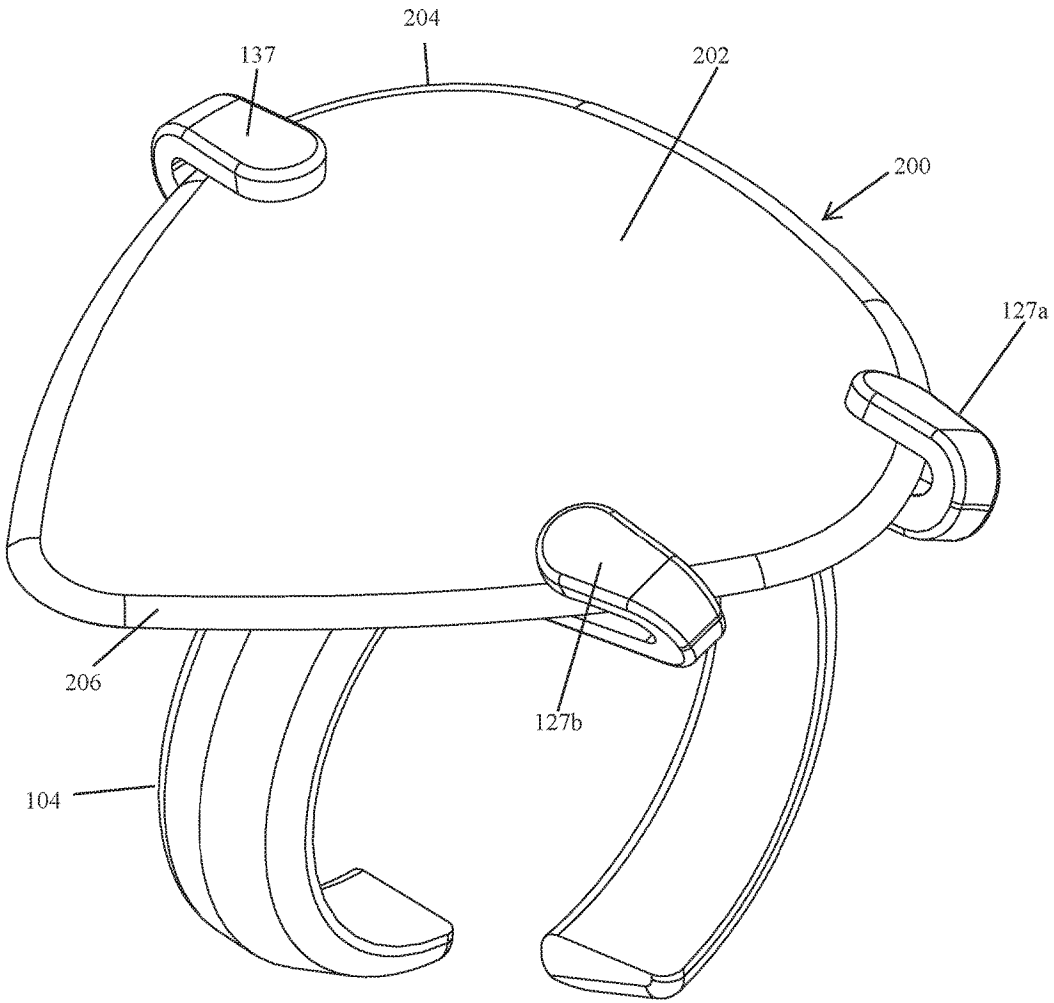
FIG. 4 is an isometric view of a guitar pick positioned within a guitar aid according to an embodiment of the present invention.
Figure 5:
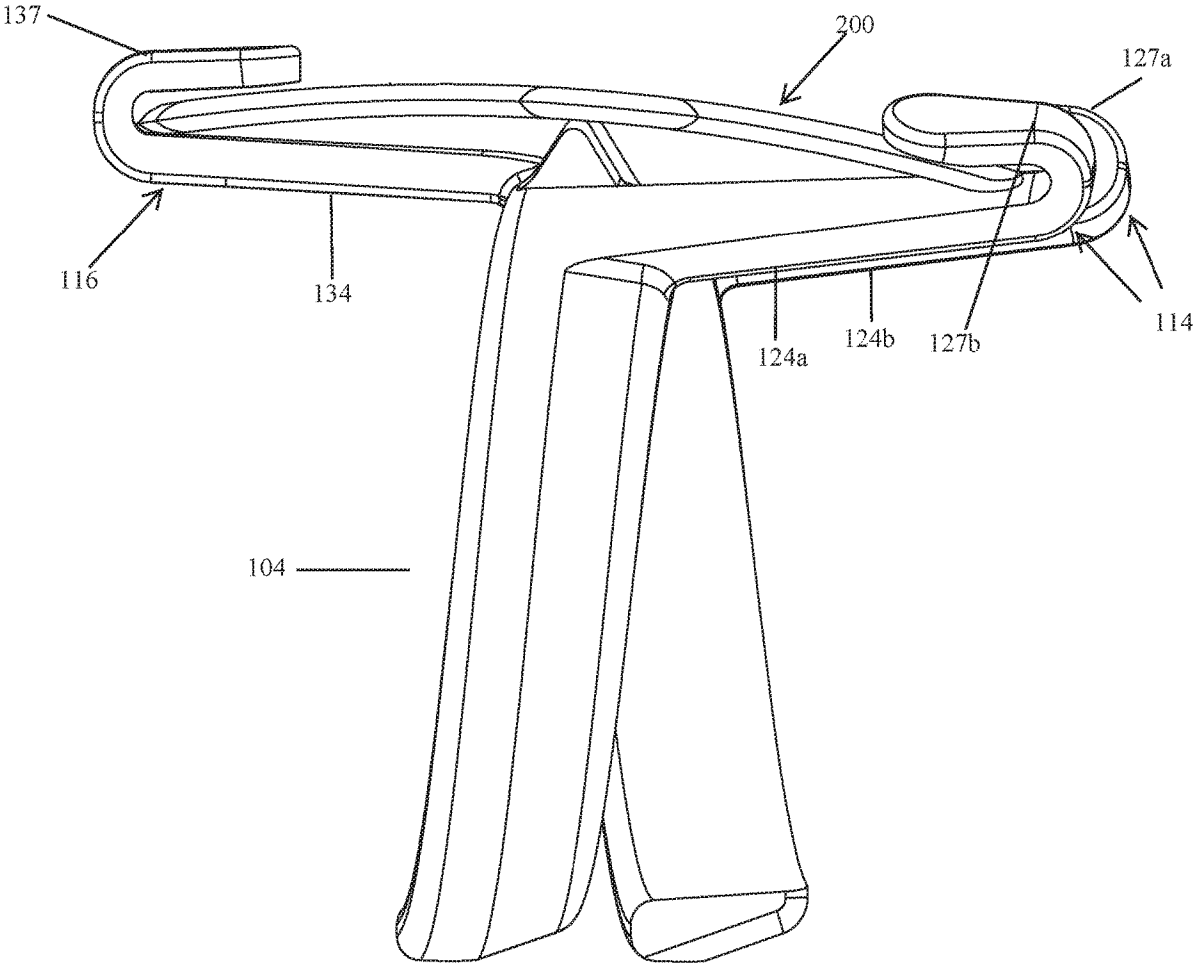
FIG. 5 is a front view of a guitar pick positioned within a guitar aid according to an embodiment of the present invention.
Figure 6:
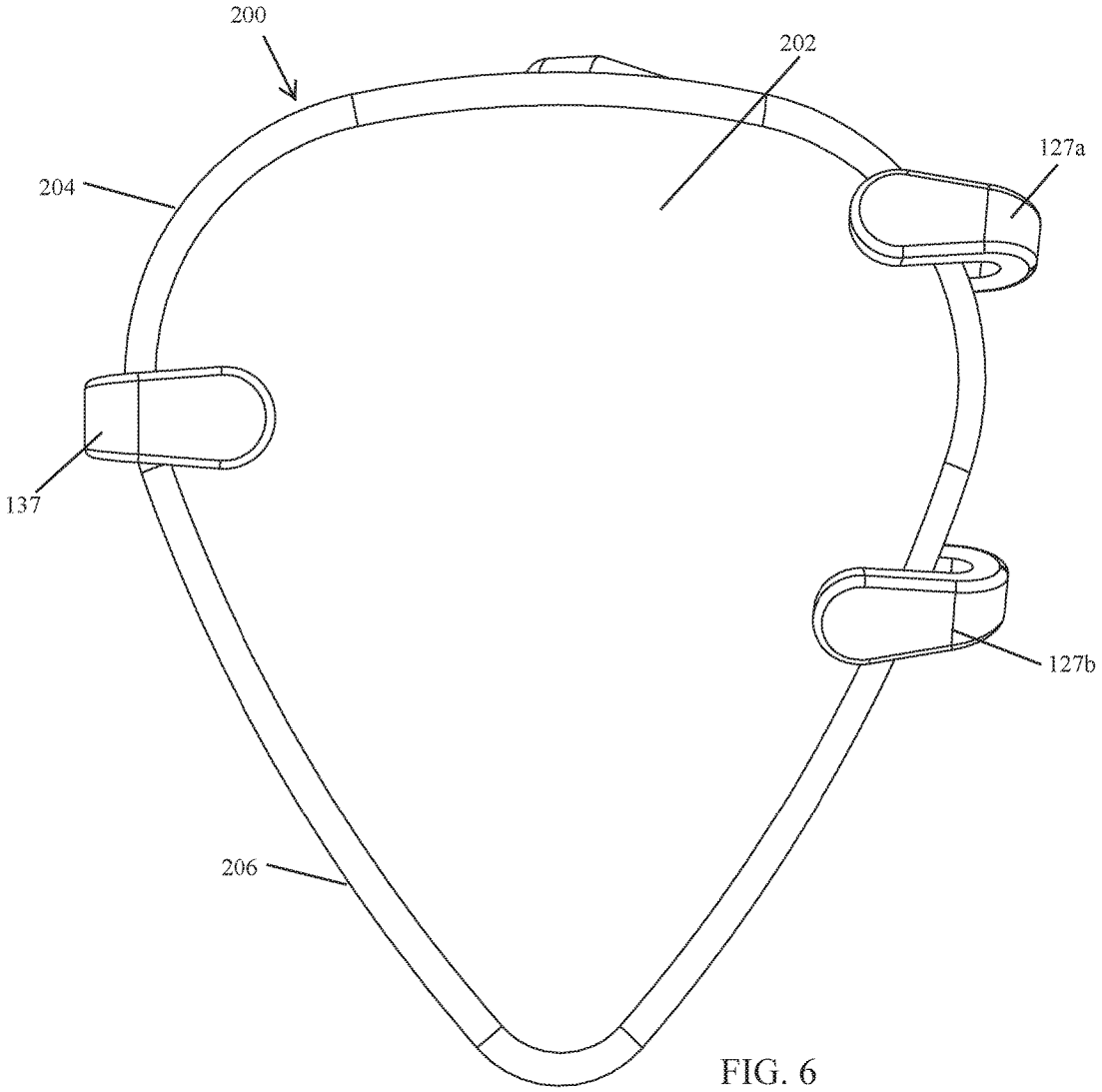
FIG. 6 is a top view of a guitar pick positioned within a guitar aid according to an embodiment of the present invention.

Referring now to FIGS. 4-6 a conventional guitar pick 200 installed within and held by a pick retainer 102 of a guitar aid 100 is depicted according to an embodiment of the present invention. Guitar pick 200 can comprise a body 202 having a wider proximal portion 204 and a narrower distal end 206. Guitar picks 200 come in a variety of standard pick sizes that can have different thicknesses. In some embodiments, guitar aid 100 can be provided in a kit along with multiple guitar picks 200 of varying thicknesses, each of which can be used with guitar aid 100 as described herein.

As depicted, body 202 of guitar pick 200 is inserted into pick retainer 102 such that the distal end 206 protrudes outwardly from pick retainer 102 for striking strings of a guitar or other stringed instrument. The proximal portion 204 of body member 202 is positioned within pick receiving channels 128*a*, 128*b*, 138 of clamp members 127*a*, 127*b*, 137, which securely hold the pick 200 in place. Guitar pick 200 can easily be inserted into and retained within guitar aid 100 with a single sliding motion without the need for additional fasteners or other parts. The guitar pick 200 can similarly be removed from guitar aid 100 by applying a pulling force on the proximal portion 204 of pick 200 without substantially distorting or moving any elements of pick retainer 102. In one embodiment, the guitar pick 200 can only be slid into pick retainer 102 with the distal end or tip 206 going first, and only be removed in the opposite direction, by withdrawing the proximal portion 204 away from the pick retainer 102. As described above, FIG. 5 depicts retention nubs 150, 152 pushing central portion of body 202 of pick 200 slightly upwards.

The relative positioning of pick retainer 102 on ring member 104 as shown in FIG. 7 determines the angle of the guitar pick 200 held by guitar aid 100. For example, pick retainer 102 and ring member 104 can be arranged such that pick 200 creates an acute angle of approximately 45 degrees with the user's finger when the user's hand is at rest. Such a configuration causes the pick to be at an approximately 90-degree angle to guitar strings 252 when the user is positioned to play the guitar, which is the optimum angle for proper sound quality. In alternate embodiments, the pick retainer 102 and ring member 104 can be arranged such that pick 200 is oriented at any other angle to the guitar strings.

To utilize guitar aids 100 as disclosed herein, a user inserts the user's index finger 254 through the ring member 104, which conforms to the size of the user's finger 254. The user grasps the upper surface of pick 200 with the user's thumb 256. In this manner, the guitar aid 100 of the present invention ensures proper alignment and a proper grip of the pick 200, which helps the user to not overuse the forearm muscles and aids in producing a proper sound from the guitar. This proper positioning and grip provided by the guitar aid 100 can further function in teaching a beginner how to properly hold a guitar pick. In addition, ring member 104 allows a user to easily slide the pick-rite guitar aid 100 up and down the user's finger to either grasp the pick for playing the instrument or move the pick out of the way to utilize the user's fingers to play the instrument, with the pliable band conforming to the size of whatever portion of the user's finger on which it is positioned. As shown in FIG. 7, in one embodiment, the first retention portion 114 having a pair of retention arms 124*a*, 124*b* is positioned further from the end of the user's finger and the second retention portion 116 including a single arm 134 is positioned nearer to the end of the user's finger. Alternatively, the opposite arrangement could be employed.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. §112(f) are not to be invoked unless the specific terms "means for" or "step for" are recited in a claim.

What is claimed is:

1. A guitar pick holding device, comprising:

a ring member defining an opening sized and shaped to fit around a finger of a user, the ring member comprising a flexible material enabling a size of the opening to be adjusted;

a pick retainer unitarily formed with the ring member, the pick retainer comprising first, second, and third retentions arms extending outwardly from the ring member and defining pick receiving channels configured to receive and secure a guitar pick therein; and at least one retention nub extending upwardly from and unitarily formed with the ring member, the retention nub configured to contact a body of the guitar pick when the guitar pick is positioned within the pick receiving channels.

2. The guitar aid of claim 1, wherein the at least one retention nub comprises two retention nubs.

3. The guitar aid of claim 2, wherein the two upward retention nubs comprise a generally inverted V-shaped configuration.

4. The guitar aid of claim 2, wherein the two retention nubs are symmetrically arranged on opposing sides of one of the retention arms.

5. The guitar aid of claim 1, wherein the ring member defines an arc having a pair of opposed ends.

6. The guitar aid of claim 5, wherein the opposed ends are laterally offset from each other.

7. The guitar aid of claim 1, wherein the retention arms each comprise a solid construct.

8. The guitar aid of claim 1, wherein the first retention arm and the second retention arm extend outwardly from the ring member in a first direction and the third retention arm extends outwardly from the ring member in an opposite direction from the first direction.

9. The guitar aid of claim 8, wherein the third retention arm is positioned between and generally equidistant from the first retention arm and the second retention arm.

10. The guitar aid of claim 8, wherein the at least one retention nub includes two retention nubs, and wherein a first retention nub is positioned between the first retention arm and the third retention arm and a second retention nub is positioned between the second retention arm and the third retention arm.

11. A guitar pick holding device, comprising:

a ring member defining an opening sized and shaped to fit around a finger of a user, the ring member comprising a flexible material enabling a size of the opening to be adjusted; and a pick retainer unitarily formed with the ring member, the pick retainer comprising first, second, and third retentions arms extending outwardly from the ring member and defining pick receiving channels configured to receive and secure a guitar pick therein, wherein the first retention arm and the second retention arm extend outwardly from the ring member in a first direction and the third retention arm extends outwardly from the ring member in an opposite direction from the first direction.

12. The guitar aid of claim 11, wherein the ring member defines an arc having a pair of opposed ends that are laterally offset from each other.

13. The guitar aid of claim 11, wherein the retention arms each comprise a solid construct.

14. The guitar aid of claim 11, wherein the third retention arm is positioned between and generally equidistant from the first retention arm and the second retention arm.

15. A guitar pick holding device, comprising:

a ring member defining an opening sized and shaped to fit around a finger of a user, the ring member comprising a flexible material enabling a size of the opening to be adjusted;

a pick retainer configured to receive and secure a guitar pick therein; and at least one retention nub extending upwardly from and unitarily formed with the ring member, the at least one retention nub configured to contact a body of the guitar pick when the guitar pick is positioned within the pick retainer, wherein the at least one retention nub comprises two retention nubs.

16. The guitar aid of claim 15, wherein the two upward retention nubs comprise a generally inverted V-shaped configuration.

17. The guitar aid of claim 15, wherein the two retention nubs are symmetrically with respect to the pick retainer.

18. The guitar aid of claim 15, wherein the ring member defines an arc having a pair of opposed ends that are laterally offset from each other.

19. The guitar aid of claim 15, wherein the pick retainer is unitarily formed with the ring member.

* * * * *